US007810954B2

(12) United States Patent
Kolodin

(10) Patent No.: US 7,810,954 B2
(45) Date of Patent: Oct. 12, 2010

(54) LED-BASED CHANGEABLE COLOR LIGHT LAMP

(75) Inventor: Boris Kolodin, Beachwood, OH (US)

(73) Assignee: Lumination LLC, Cleveland, OH (US)

( * ) Notice: Subject to any disclaimer, the term of this patent is extended or adjusted under 35 U.S.C. 154(b) by 310 days.

(21) Appl. No.: 11/949,143

(22) Filed: Dec. 3, 2007

(65) Prior Publication Data

US 2009/0141474 A1 Jun. 4, 2009

(51) Int. Cl.
*F21S 8/00* (2006.01)

(52) U.S. Cl. ..... 362/277; 362/231; 362/311.01

(58) Field of Classification Search ..... 362/231, 362/34, 208, 277, 281, 253, 293, 311.01, 362/433, 455, 458; 257/98, 99, 100
See application file for complete search history.

(56) References Cited

U.S. PATENT DOCUMENTS 2,107,648 A * 2/1938 Putterman ..... 362/317
4,546,416 A * 10/1985 Pemberton ..... 362/84
5,014,171 A * 5/1991 Price, III ..... 362/277
6,234,648 B1 5/2001 Borner et al.
6,541,800 B2 * 4/2003 Barnett et al. ..... 257/98
7,258,816 B2 * 8/2007 Tamaki et al. ..... 252/301.4 F
2003/0039120 A1 2/2003 Cao
2005/0162864 A1 7/2005 Verdes et al.
2005/0243550 A1 11/2005 Stekelenburg

* cited by examiner

*Primary Examiner*—Gunyoung T Lee
(74) *Attorney, Agent, or Firm*—Fay Sharpe LLP; John M. Ling

(57) ABSTRACT

Systems and methods are described that facilitate providing a user with interchangeable phosphor-coated shells, or envelopes, for generate different shades and intensities of white light from a single UV light source. The interchangeability of the low-cost phosphor-coated envelopes permits the use of a single light engine, which is the more expensive component of a solid state lamp. In this manner, consumers are provided with a greater number of lighting choices at low cost than can be achieved using conventional single-envelope lamps.

20 Claims, 4 Drawing Sheets

LED-BASED CHANGEABLE COLOR LIGHT LAMP

BACKGROUND

The subject innovation relates generally to light emitting diode (LED) lighting sources and processes. It finds particular application in conjunction with changeable phosphor coated envelopes for ultraviolet (UV) LED light engines, and will be described with particular reference thereto. However, it is to be appreciated that the systems and methods described herein are also amenable to other applications.

Light emitting diodes (LEDs) are semiconductor light emitters often used as a replacement for other light sources, such as incandescent lamps. They are particularly useful as display lights, warning lights and indicating lights or in other applications where colored light is desired. The color of light produced by an LED is dependent on the type of semiconductor material used in its manufacture.

By interposing a phosphor excited by the radiation generated by the LED, light of a different wavelength, e.g., in the visible range of the spectrum, may be generated. Colored LEDs are used in a number of commercial applications such as toys, indicator lights, automotive, display, safety/emergency, directed area lighting and other devices. Manufacturers are continuously looking for new colored phosphors for use in such LEDs to produce custom colors and higher luminosity.

There is a large potential market for solid-state lamps (SSL) for general illumination applications. Solid state lamps based on power LED packages demonstrate efficiency around 50-70 Lm/W and expected life of approximately 50,000 hours, which approaches compact fluorescent lamp (CFL) efficiency of 70-80 Lm/W at 9000 hours. However, obstacles for SSL market penetration include high product cost, and thus design innovations that decrease lamp cost and/or purchase price are needed to accelerate broad adoption of solid-state lighting.

There exists a need for systems and/or methods that overcome the above-mentioned deficiencies and others.

BRIEF DESCRIPTION

According to one aspect, a solid state lamp assembly comprises an ultraviolet (UV) light source, a housing in which the UV light source is positioned, and a plurality of removable phosphor-coated envelopes, each of which comprises a coupling for removably coupling to the housing. Each envelope is coated with a different phosphor material that generates a different correlated color temperature (CCT) when illuminated by the UV light source.

According to another aspect, a low-cost variable output solid state lamp (SSL) comprises an ultraviolet (UV) light engine coupled to an interior surface of a lamp housing, a plurality of envelopes removably attachable to the lamp housing opposite the light engine, each envelope comprising a different phosphor material, and at least one bayonet pin on the lamp housing that is received by a corresponding slot on an envelope when the envelope is coupled to the housing. Each phosphor material emits a different correlated color temperature of white light when excited by UV light from the light engine.

According to another aspect, a variable output solid state lighting apparatus, comprises means for generating ultraviolet (UV) light, means for mounting the means for generating UV light, means for altering the UV light into one of a plurality of selectable white light calibrated color temperatures, and means for removably coupling the means for altering to the means for mounting.

BRIEF DESCRIPTION OF THE DRAWINGS

FIG. 4A illustrates a cross-section of a lamp that may be employed as a flood light or interior light source, or the like.

DETAILED DESCRIPTION

Figure 1:
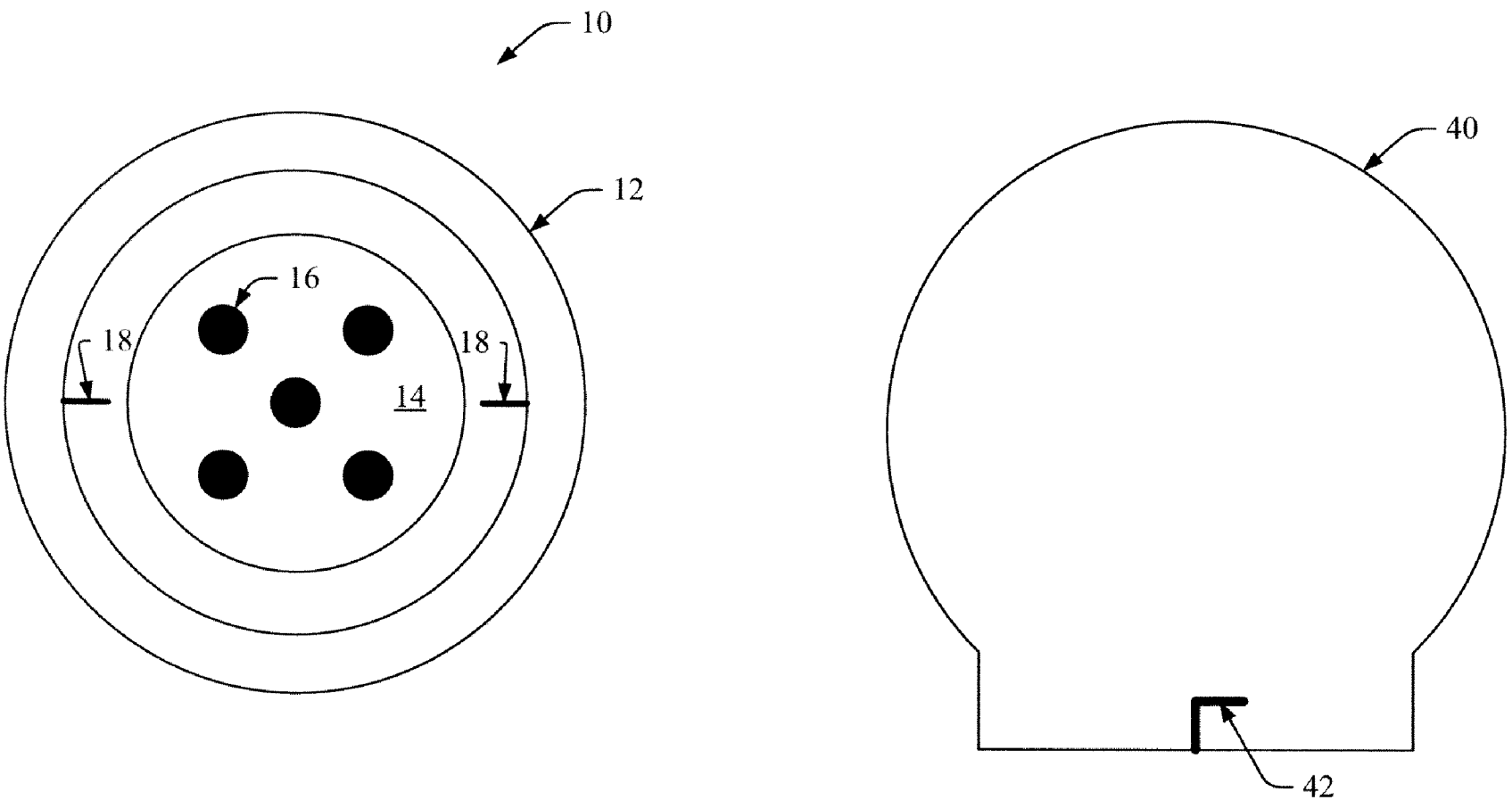
FIG. 1 illustrates an SSL that comprises a lamp housing with an LED light engine including one or more LEDs.

Systems and methods are described herein, which facilitate providing a plurality of interchangeable phosphor-coated envelopes or shells for a UV light engine in a solid state lamp (SSL) to permit a user to select different white light intensities, or temperatures, depending on user mood, time of year, or other lighting choice parameters. FIG. 1 illustrates an SSL 10 that comprises a lamp housing 12 with an LED light engine 14 including one or more LEDs 16. The light engine 14 additionally comprises embedded power conversion circuitry (not shown), which permits the lamp 10 to be plugged in or otherwise wired to a standard commercial or residential electrical system, or some other suitable power source. The lamp further includes a coupling 18 for removably coupling a phosphor-coated envelope (see FIGS. 2 and 3). According to an example, the light engine 14 can employ near-UV power LEDs together with RGB phosphor, which is embedded in or coated on an envelope or shell, and which defines a correlated color temperature (CCT) for the SSL 10.

A phosphor-coated envelope 40 has a coupling groove 42, which receives the coupling 18. In the figure, a side portion of the envelope is folded outward to show the bayonet coupling groove, for illustrative purposes only. In one example, the couplings 18 are pins for a bayonet-type coupling, and the coupling groove 42 receives the pins. It will be appreciated that any number of coupling means 18, 42 can be employed to couple the envelope 40 to the lamp housing 12. For instance, sides of the housing can be threaded, and corresponding sides of the envelope 40 can be threaded in a complementary fashion, to permit the envelope to be screwed onto the housing. In another example, the housing and envelope can overlap each other, and a ring (not shown) of resilient seal material (e.g., rubber, synthetic polymer, silicone, etc.) can be positioned between the overlapping portions (e.g., sides) of the housing and envelope to provide a reusable seal for a snug fit there between when the housing and envelope are mated together. Alternatively, a plurality of retaining nodes (not shown) of similar material to the above-described ring can be positioned about the perimeter of the housing and/or the interior sides of the envelope to provide the snug fit between the mated housing and envelope. The ring and/or the retaining nodes can be fixed to the sides of the envelope or to the sides of the housing.

According to another example, the lamp 10 is a down-converted LED lamp and the light engine 14 is a UV light engine. Using interchangeable phosphor-coated envelopes facilitates minimizing unit cost while providing multiple lighting options, as the light engine and power supply are typically the more costly components of a solid state lamp, such as the lamp 10. The envelopes can be coated with phosphor material that, when excited by UV light from the light engine, emits a given shade or hue of white light (e.g., cool white, warm white, bluish-white, etc.)

For example, changeable phosphor incorporated envelops 40 with CCTs corresponding to "warm," (approximately 2700 K), "natural daylight" (approximately 6000 K) and "cool" (approximately 15000 K) light can be provided to a user, who can then switch the envelopes out depending on the user's desired light quality. In this example, consumers can change a lamp's CCT according to their preferences (e.g., winter season-warm white, summertime-cool white) for approximately the price of a conventional single-color lamp. In this 3-envelope example, a dollars-to-lumens ratio can be reduced approximately 2.5-3 times, which can facilitate solid state lamp penetration to the general illumination market, which has the advantages of reducing power consumption on a world-wide scale and providing cost-savings to the end-user. It will be appreciated that any number of different interchangeable phosphor envelops can be provided to the user, and that the aspects and features described herein are not limit to a 3-envelope embodiment.

Figure 2:
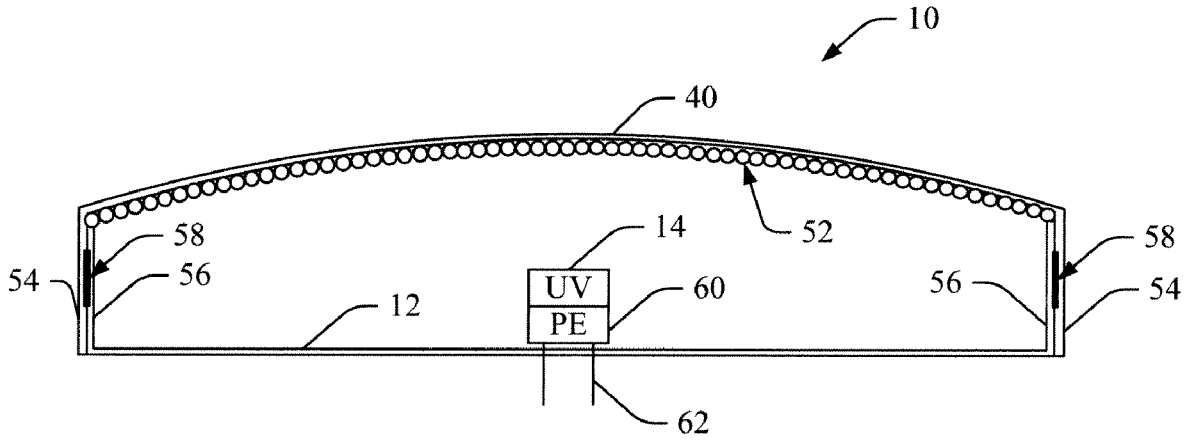
FIG. 2 illustrates a cross-section of the assembled SSL is shown, wherein the shell or envelope is coupled to the lamp housing.

With reference to FIG. 2, a cross-section of the assembled SSL 10 is shown, wherein the shell or envelope 40 is coupled to the lamp housing 12. The visible surface (e.g., the surface visible to an observer) of the envelope 40 is coated with phosphor material 52. It will be appreciated that the phosphor material may be embedded in the envelope material, coated on the outer surface of the envelope, or coated on the interior surface of the envelope as shown, in accordance with different embodiments. The envelope additionally comprises a side portion(s) 54, which may be cylindrical in shape and perpendicular to the visible surface of the envelope. The side portion 54 mates with a side portion 56 of the housing 12, which has a complementary shape to the side portion 56. A resilient retaining means 58 (e.g., rubber, silicone, etc.) is positioned between the side portion 56 and the side portion 54 to provide a snug but removable coupling there between. The coupling means may be affixed to either the housing side or the envelope side, and may comprise a plurality of spaced-apart coupling nodes or a continuous ring of coupling material that runs the circumference of the housing side or the envelope side.

The UV source 14 is coupled to the housing, along with power electronics 60 that are wired to power source (not shown) via leads 62. The power source may be a residential or commercial electrical framework, a vehicle power supply (e.g., in a car, bus, motor home, boat, aircraft, etc.), or some other suitable power source. The UV source illuminates and excites the phosphor material 52, causing white light to be emitted from the visible surface of the envelope 40.

The phosphor material 52 is deposited on (or embedded in) the envelope 40 by any appropriate method. For example, a water based suspension of the phosphor(s) can be formed, and applied as a phosphor layer to the envelope surface. In one such method, a silicone slurry in which the phosphor particles are randomly suspended is placed on the envelope. This example is merely exemplary of possible positions of the phosphor material 52 on the envelope 40. Thus, the phosphor material 52 may be coated over or directly on the light emitting surface of the envelope by coating and drying the phosphor suspension on the envelope. Although not intended to be limiting, in one embodiment, the median particle size of the phosphor material may be from about 1 to about 10 microns.

The phosphor material may be an individual phosphor or a phosphor blend of two or more phosphor compositions, including individual phosphors that convert radiation at a specified wavelength, for example radiation from about 250 to 550 nm as emitted by a UV-to-visible LED, into a different wavelength of visible light. The visible light provided by the phosphor material (and LED chip if emitting visible light) comprises a bright white light with high intensity and brightness.

The lamp may include any semiconductor visible or UV light source that is capable of producing white light when its emitted radiation is directed onto the phosphor. The peak emission of the LED chip in the present invention will depend on the identity of the phosphors in the disclosed embodiments and may range from, e.g., 250-550 nm. In one embodiment, however, the emission of the LED will be in the near UV to deep blue region and have a peak wavelength in the range from about 350 to about 500 nm. Typically then, the semiconductor light source comprises an LED doped with various impurities. Thus, the LED may comprise a semiconductor diode based on any suitable III-V, II-VI or IV-IV semiconductor layers and having a peak emission wavelength of about 250 to 550 nm.

The LED may contain at least one semiconductor layer comprising GaN, ZnSe or SiC. For example, the LED may comprise a nitride compound semiconductor represented by the formula $In_jGa_kAl_lN$ (where $0 \leqq j$; $0 \leqq k$; $0 \leqq l$ and $j+k+l=1$) having a peak emission wavelength greater than about 250 nm and less than about 550 nm. Such LED semiconductors are known in the art. The radiation source is described herein as an LED for convenience. However, as used herein, the term is meant to encompass all semiconductor radiation sources including, e.g., semiconductor laser diodes.

Although the general discussion of the exemplary structures of the invention discussed herein are directed toward inorganic LED based light sources, it should be understood that the LED chip may be replaced by an organic light emissive structure or other radiation source unless otherwise noted and that any reference to LED chip or semiconductor is merely representative of any appropriate radiation source.

The phosphor material may be coated on the inside surface of the envelope 40 and/or coated on the outside surface of the envelope, if desired. The phosphor material 52 may be coated on the entire surface of the envelope or only a top portion of the surface of the envelope. Portions of the envelope surface that do not have phosphor embedded in or coated thereon can be covered by a UV-reflective material to prevent direct penetration of UV radiation. Radiation emitted by the UV LED light engine 14 mixes with the light emitted by the phosphor material 52, and the mixed light appears as white light.

While suitable in many applications alone with a blue or UV LED chip, the above described phosphor may be blended with one or more additional phosphors for use in LED light sources. Thus, in another embodiment, an LED lighting assembly is provided including a phosphor composition comprising a blend of a phosphor from one of the above embodiments with one or more additional phosphors. These phosphors can be used either individually for single color lamps or in blends with other phosphors to generate white light for general illumination. These phosphors can be blended with suitable phosphors to produce a white light emitting device with CCTs ranging from approximately 2000 to approximately 16,000 K and color rendering indices (CRIs) ranging from 50-99. Non-limiting examples of suitable phosphors for use with the present inventive phosphors in phosphor blends are listed below.

The specific amounts of the individual phosphors used in the phosphor blend will depend upon the desired color temperature. The relative amounts of each phosphor in the phosphor blend can be described in terms of spectral weight. The spectral weight is the relative amount that each phosphor contributes to the overall emission spectrum of the device. The spectral weight amounts of all the individual phosphors and any residual bleed from the LED source should add up to 100%. In an embodiment of blended phosphors, the above described phosphor in the blend will have a spectral weight ranging from about 1 to 75%.

while not intended to be limiting, suitable phosphors for use in or on the envelope 40 include:

$(Ba,Sr,Ca)_5(PO_4)_3(Cl,F,Br,OH):Eu^{2+}, Mn^{2+}$
$(Ba,Sr,Ca)BPO_5:Eu^{2+}, Mn^{2+}$
$(Sr,Ca)_{10}(PO_4)_6*vB_2O_3:Eu^{2+}$ (wherein $0<v\leqq 1$)
$Sr_2Si_3O_8*2SrCl_2:Eu^{2+}$
$(Ca,Sr,Ba)_3MgSi_2O_8:Eu^{2+}, Mn^{2+}$
$BaAl_8O_{13}:Eu^{2+}$
$2SrO*0.84P_2O_5*0.16B_2O_3:Eu^{2+}$
$(Ba,Sr,Ca)MgAl_{10}O_{17}:Eu^{2+}, Mn^{2+}$
$(Ba,Sr,Ca)Al_2O_4:Eu^{2+}$
$(Y,Gd,Lu,Sc,La)BO_3:Ce^{3+}, Tb^{3+}$
$(Ba,Sr,Ca)_2Si_{1-\xi}O_{4-2\xi}:Eu^{2+}$ (wherein $0\leqq\xi\leqq 0.2$)
$(Ba,Sr,Ca)_2(Mg,Zn)Si_2O_7:Eu^{2+}$
$(Sr,Ca,Ba)(Al,Ga,In)_2S_4:Eu^{2+}$
$(Y,Gd,Tb,La,Sm,Pr,Lu)_3(Al,Ga)_{5-\lambda}O_{12-3/2\lambda}:Ce^{3+}$ (wherein $0\leqq\lambda\leqq 0.5$)
$(Lu,Y,SC)_{2-\rho}(Ca,Mg)_{1+\rho}Li\sigma Mg_{2-\sigma}(Si,Ge)_{3-\sigma}P_\sigma O_{12-\rho}:Ce^{3+}$ (wherein $0\leqq\rho\leqq 0.5$, $0\leqq\sigma\leqq 0.5$)
$(Ca,Sr)_8(Mg,Zn)(SiO_4)_4Cl_2:Eu^{2+}, Mn^{2+}$
$Na_2Gd_2B_2O_7:Ce^{3+}, Tb^{3+}$
$(Sr,Ca,Ba,Mg,Zn)_2P_2O_7:Eu^{2+}, Mn^{2+}$
$(Gd,Y,Lu,La)_2O_3:Eu^{3+}, Bi^{3+}$
$(Gd,Y,Lu,La)_2O_2S:Eu^{3+}, Bi^{3+}$
$(Gd,Y,Lu,La)VO_4:Eu^{3+}, Bi^{3+}$
$(Ca,Sr)S:Eu^{2+}$
$(Ca,Sr)S:Eu^{2+}, Ce^{3+}$
$SrY_2S_4:Eu^{2+}$
$CaLa_2S_4:Ce^{3+}$
$(Ba,Sr,Ca)MgP_2O_7:Eu^{2+}, Mn^{2+}$
$(Y,Lu)_2WO_6:Eu^{3+}, Mo^{6+}$
$(Ba,Sr,Ca)_\beta Si_\gamma N_\mu:Eu^{2+}$ (wherein $2\beta+4\gamma=3\mu$)
$Ca_3(SiO_4)Cl_2:Eu^{2+}$
$(Y,Lu,Gd)_{2-\phi}Ca_\phi Si_4N_{6+\phi}C_{1-\phi}:Ce^{3+}$ (wherein 0, $\leqq\phi\leqq 0.5$)
$(Lu,Ca,Li,Mg,Y)\alpha$-SiAlON doped with $Eu^{2+}$ and/or $Ce^{3+}$
$3.5MgO*0.5MgF_2*GeO_2:Mn^{4+}$ For purposes of the present application, it should be understood that when a phosphor is listed with two or more dopant ions (i.e. those ions following the colon in the above compositions), the phosphor has at least one (but not necessarily all) of those dopant ions within the material. That is, as understood by those skilled in the art, this type of notation means that the phosphor can include any or all of those specified ions as dopants in the formulation.

As stated, the phosphors can be used either alone to make single color light sources or in blends for white light sources. In one embodiment, the phosphor composition is a blend of one or more of the above phosphors and one or more gap filling phosphors, such that the light emitted from the LED device is a white light.

When the phosphor composition includes a blend of two or more phosphors, the ratio of each of the individual phosphors in the phosphor blend may vary depending on the characteristics of the desired light output. The relative proportions of the individual phosphors in the various embodiment phosphor blends may be adjusted such that when their emissions are blended and employed in an backlighting device, there is produced visible light of predetermined x and y values on the CIE chromaticity diagram. As stated above, a white light is produced. This white light may, for instance, possess an x value in the range of about 0.30 to about 0.55, and a y value in the range of about 0.30 to about 0.55. As stated, however, the exact identity and amounts of each phosphor in the phosphor composition can be varied according to the needs of the end user.

Figure 3:
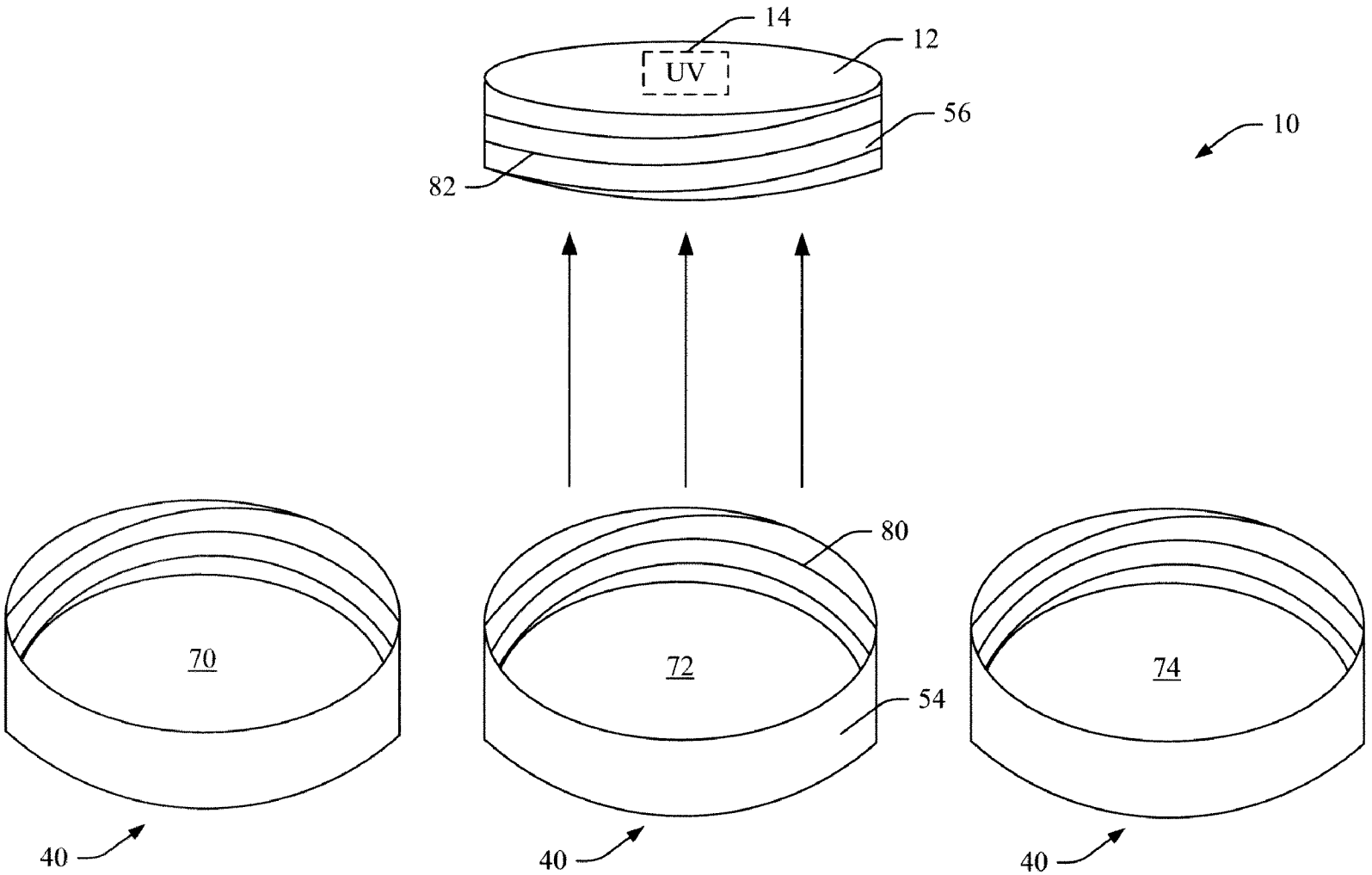
FIG. 3 illustrates the interchangeable SSL wherein the lamp housing and a plurality of different phosphor-coated envelopes are threaded for quick replacement depending on a user's lighting preference.

FIG. 3 illustrates the interchangeable SSL 10 wherein the lamp housing 12 and a plurality of different phosphor-coated envelopes 40 are threaded for quick replacement depending on a user's lighting preference. The UV source 14 (and power electronics, etc.) are mounted to the interior of the housing 12. Optionally, a heat sink (not shown) may be coupled to one or more of the LED source, power electronics, and/or housing to dissipate heat, thereby allowing more powerful light sources to be employed that would be possible without the heat sink. Each envelope 40 is coated with a different phosphor material to generate a different white light from the UV source 14. For instance a first envelope 40*a* is coated with a first phosphor material 70 that generates a warm white light (e.g., with a CCT of approximately 2500-3000 K). A second envelope 40*b* is coated with a second phosphor material 72 to generate a white light that approximates natural daylight (e.g., with a CCT of approximately 5000-7000 K). A third envelope 40*c* is coated with a third phosphor material 74 to generate a "cool" white light (e.g., with a CCT of approximately 14000-16000 K). The envelopes 40 are interchangeable depending on user preferences.

The interiors of the envelope sides 54 have a plurality of threads 80 that mate with complementary threads 82 on the housing sides 56. When a user desires a lighting change, the user unscrews an envelope that is currently coupled to the housing, and replaces it with another of the envelopes. In this manner, a user can select between multiple types of light, all produced from a common UV source. Moreover, the cost to manufacture or purchase the interchangeable SSL 10 approaches 1/N, where N is the number of interchangeable envelopes, when compared to the same number of conventional non-interchangeable single-envelope lamps.

Figure 4B:
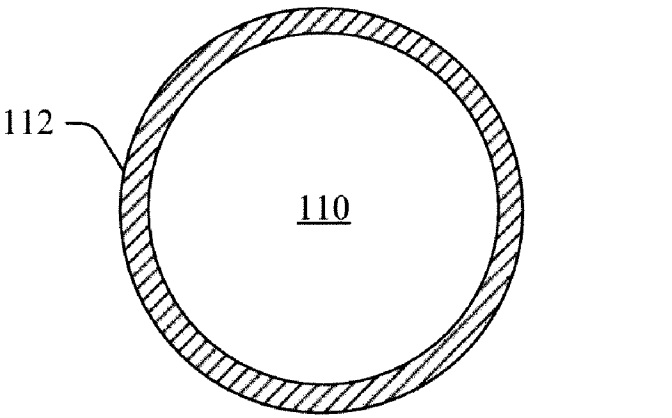
FIG. 4B illustrates a top-down view of the framed film, which includes a film portion that is attached to a substantially circular frame.
Figure 4C:
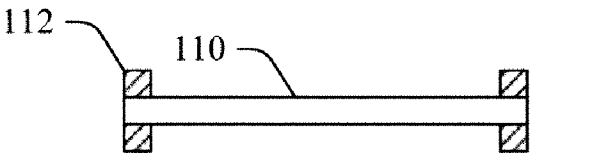
FIG. 4C illustrates a side-view cross section of the framed film, showing the film pressed between frame elements.
Figure 4A:
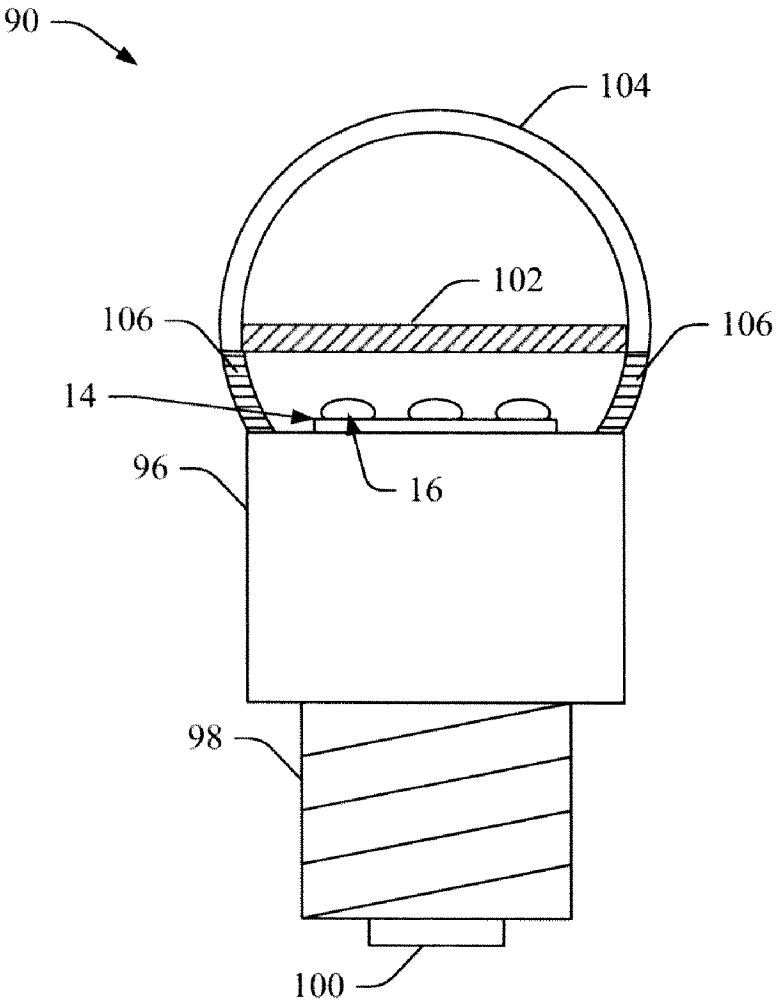

FIG. 4A illustrates a cross-section of a lamp 90 that may be employed as a flood light or interior light source, or the like. The lamp 90 includes a light engine 14 with one or more LEDs 16 mounted thereon. In one embodiment, the LEDs are UV LEDs. The light engine is coupled to an AC-DC power converter 96, which may include and/or act as a heat sink. The converter 96 is further coupled to a screw-type connector 98, through which an electrical conductor 100 runs to connect the converter 96 to an electrical contact in a socket (not shown) to receive power from an AC power source.

The lamp 90 further includes a framed film 102 with RGB phosphor embedded therein (or coated thereon). The framed film 102 (e.g., Teflon film, silicon film, etc.) is replaceable to provide different light colors and may be fixed to a transparent acrylic (e.g., hard silicone) envelope using a compressed thread connection or the like. The transparent acrylic envelope 104 is coupled to the converter 96, and includes a UV-reflective material, which covers internal surface of transparent envelope between the framed RGB phosphor film and the power converter. UV reflective material may comprise a metal layer, silicone filled by titanium oxide ($TiO_2$), and/or a 3M omnidirectional film reflector). Light from the LEDs is converted to white light by the film layer 102 before being emitted out through the envelope 104.

FIG. 4B illustrates a top-down view of the framed film 102, which includes a film portion 110 that is attached to a substantially circular frame 112 (e.g., by a hot-pressing technique or the like).

FIG. 4C illustrates a side-view cross section of the framed film 102, showing the film 110 pressed between frame elements 112. In one embodiment, the frame elements are formed of a plastic or similar material.

Various embodiments and examples of the innovation have been described herein. It is appreciated that modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A solid state lamp assembly, comprising:

an ultraviolet (UV) light source;

a housing in which the UV light source is positioned;

a plurality of removable and interchangeable phosphor-coated envelopes, each of which comprises a coupling for removably coupling to the housing;

wherein each envelope is coated with a different phosphor material that generates a different correlated color temperature (CCT) of white light when illuminated by the UV light source.

2. The lamp assembly of claim 1, further comprising a power electronics circuit board coupled to the interior of the housing, and on which the UV light source is mounted.

3. The lamp assembly of claim 2, wherein the power electronics circuit board is coupled to a power supply and supplies power to the UV light source.

4. The lamp assembly of claim 3, wherein the UV light source comprises at least one UV light-emitting diode (LED).

5. The lamp assembly of claim 4, wherein the plurality of removable phosphor-coated envelopes comprises at least first, second, and third envelopes that are coated with at least first, second, and third phosphor materials, respectively, that emit white light having at least three different CCTs when excited by the UV light source.

6. The lamp assembly of claim 5, wherein the first phosphor material has a CCT of approximately 2500-3000 K when excited by the UV light source.

7. The lamp assembly of claim 6, wherein the second phosphor material has a CCT of approximately 5000-7000 K when excited by the UV light source.

8. The lamp assembly of claim 6, wherein the third phosphor material has a CCT of approximately 14000-16000 K when excited by the UV light source.

9. The lamp assembly of claim 1, wherein the plurality of removable phosphor-coated envelopes comprises at least first, second, and third envelopes that are coated with at least first, second, and third phosphor materials, respectively, that emit white light having at least three different CCTs when excited by the UV light source.

10. The lamp assembly of claim 9, wherein the first phosphor material has a CCT of approximately 2500-3000 K when excited by the UV light source.

11. The lamp assembly of claim 9, wherein the second phosphor material has a CCT of approximately 5000-7000 K when excited by the UV light source.

12. The lamp assembly of claim 9, wherein the third phosphor material has a CCT of approximately 14000-16000 K when excited by the UV light source.

13. The lamp assembly of claim 1, wherein the coupling comprises a layer of resilient material positioned between an envelope and the housing to provide a snug fit and hold the envelope in place when the envelope is removably coupled to the housing.

14. The lamp assembly of claim 13, wherein the coupling comprises a ring of resilient material positioned between a cylindrical side of the housing and a complementary cylindrical side of each envelope.

15. The lamp assembly of claim 1, wherein a cylindrical side of each envelope is threaded to couple to, and decouple from, a threaded cylindrical side of the housing.

16. A low-cost variable output solid state lamp (SSL), comprising:

an ultraviolet (UV) light engine coupled to an interior surface of a lamp housing;

a plurality of envelopes that are interchangeable and removably attachable to the lamp housing opposite the light engine, each envelope comprising a different phosphor material; and at least one bayonet pin on the lamp housing that is received by a corresponding slot on an envelope when the envelope is coupled to the housing;

each phosphor material emits a different correlated color temperature of white light when excited by UV light from the light engine.

17. The lamp of claim 16, wherein respective phosphor materials are coated on an interior surface of respective envelopes.

18. The lamp of claim 17, wherein the plurality of phosphor-coated envelopes comprises first, second, and third envelopes that are coated with first, second, and third phosphor materials having CCTs of approximately 2500 K, approximately 6000 K, and approximately 15000 K, respectively.

19. A variable output solid state lighting apparatus, comprising:

means for generating ultraviolet (UV) light;

means for mounting the means for generating UV light;

means for altering the UV light into one of a plurality of selectable white light correlated color temperatures, said means for altering including providing a plurality of interchangeable envelopes, wherein each envelope is coated with a different phosphor; and means for removably coupling the means for altering to the means for mounting.

20. The apparatus of claim 19, wherein the means for coupling comprises at least one of a bayonet-type connector, a reusable seal connector, or threaded connector.

* * * * *